United States Patent [19]

Obara et al.

[11] Patent Number: 4,586,965

[45] Date of Patent: May 6, 1986

[54] PRODUCTION OF A BASE STEEL SHEET TO BE SURFACE-TREATED WHICH IS TO PRODUCE NO STRETCHER STRAIN

[75] Inventors: Takashi Obara; Kazunori Osawa; Minoru Nishida; Kei Sakata; Hideo Kuguminato, all of Chiba, Japan

[73] Assignee: Kawasaki Steel Corporation, Kobe, Japan

[21] Appl. No.: 739,623

[22] Filed: May 31, 1985

[30] Foreign Application Priority Data

Jun. 8, 1984 [JP] Japan ..... 59-116612

[51] Int. Cl.[4] ..... C21D 9/46

[52] U.S. Cl. ..... 148/12 D

[58] Field of Search ..... 148/12 D

[56] References Cited

U.S. PATENT DOCUMENTS

| | | | |
|---|---|---|---|
| 3,947,294 | 3/1976 | Asamura et al. | 148/12 D |
| 4,350,538 | 9/1982 | Imai et al. | 148/12 D |
| 4,368,084 | 1/1983 | Irie et al. | 148/12 D |
| 4,517,031 | 5/1985 | Takasaki et al. | 148/12 D |

*Primary Examiner*—Wayland Stallard

*Attorney, Agent, or Firm*—Balogh, Osann, Kramer, Dvorak, Genova & Traub

[57] ABSTRACT

Disclosed herein is a method of manufacturing a base steel sheet, which method comprises combined steps of: not rolling a steel slab containing not more than 0.0070% by weight of C (hereinafter referred to briefly as "%"), not more than 0.1% of Si, not more than 0.5% of Mn, 0.010 to 0.080% of Al, not more than 0.0050% of N, not more than 0.030% of S provided that the ratio of Mn/S is not less than 10, and not more than 0.030% of P while the hot rolling being terminated at a finish temperature of not less than 800° C.; cold rolling thus obtained hot rolled steel sheet in an ordinary manner; continuously annealing the cold rolled steel sheet in which heating is done up to a temperature from a recrystallization temperature to 800° C., followed by cooling; and then temper rolling the annealing steel sheet at a reduction of not less than 7% by using two or more stand rolling mill, whereby the thus obtained base sheet, to be surface-treated may be utilized for a tinplate or a tin free steel in which no stretcher strain is formed even after baking treatment.

1 Claim, 3 Drawing Figures

PRODUCTION OF A BASE STEEL SHEET TO BE SURFACE-TREATED WHICH IS TO PRODUCE NO STRETCHER STRAIN

BACKGROUND OF THE INVENTION (1) Field of the Invention

The present invention relates to the production of a base sheet to be surface-treated, that is, a steel sheet as a base steel sheet to be plated for a surface-treated sheet such as tinplate and tin free steel in which a steel sheet is thinly plated with Sn or Cr, and is to effectively avoid the occurrence of the stretcher strain in the treatment, particularly drawing, made on the surface-treated steel sheet.

For instance, according to the JISG3303, the tempering degree is classified into several ranges from T-1(HR30T:49±3) to T-6(HR30T:70±3) depending upon intended Rockwell T hardnesses (HR30T). Such classification is made with respect to the box annealing, and in particular the classification from the T-4-CA to T-6-CA (HR30T:61±3 to 70±3) is specified with respect to the continuous annealing. The present invention is particularly suitable for the tinplate having the tempering degree of T2 or higher among the above-mentioned classification ranges and tin-free steel similar thereto.

(2) Description of the Prior Art

As the base steel sheet of T-1 to T-4 grades to be plated as tinplate, there has been heretofore mainly used a low carbon aluminum-killed steel having 0.01 to 0.10% by weight (hereinafter also referred to briefly as "%" with respect to the other components of the steel), while as the base sheet of T-5 and T-6 grades, use has been principally made of a low carbon aluminum-killed steel in which P or N is added to increase the hardness.

The relation between the annealing method performed on the base steel sheet to be surface-treated and the properties of the tinplate is as follows: Box annealing:

Since cooling is gradually performed down near room temperature in a few or several days after recrystallization (550°-700° C.), most of carbon in the steel precipitates as carbide. On the other hand, nitrogen in the steel precipitates as aluminum nitride during heating.

That is, since C and N in the steel are not present in solid-solution state, even when the temper rolling and plated tin-alloying treatment (a so-called reflow treatment in which the steel is maintained at 230°-250° C. for a few seconds) after tin-plating are carried out, strain aging does not occur to cause no yield point elongation.

Continuous annealing

After heating is carried out rapidly up to 600° to 730° C. at 10°-30° C./sec., and recrystallization is performed while the temperature is kept for several ten seconds, cooling is carried out down to room temperature at 5°-50° C./sec. Accordingly, most of C and N exist in the solid-solution state. Consequently, the dislocation is introduced into the steel through temper rolling and solute C and N precipitated on the dislocation lines through plated tin-alloying treatment after the tin plating cause strain aging hardening. Thus, when this steel sheet is worked into a can or the like, "texture" pattern (called "stretcher strain") caused by yield point elongation is formed to conspicuously deteriorate the outer appearance. Further, as the technique of producing a soft tin plate through quenching and subsequent overaging treatment in the continuous annealing, there has been recently known the technique disclosed in Japanese Patent Application Laid-open No. 27,933/1983. However, according to this technique, the occurrence of the stretcher strain could not be avoided yet. The stretcher strain occurs considerably particularly when the temperature is kept at not less than 200° C. for as long as about 10 minutes as in the case of the baking finishing treatment.

That is, not a few stretcher strain is produced in the soft tinplate having around a temper degree of T-2 to T-3 which have been conventionally produced in the continuous annealing, which causes troubles.

On the other hand, there has been known Japanese Patent Publication No. 3,413/1981 as the technique of manufacturing the hard tinplate having around a tempering degree of T-4 to T-6 through the combination of the continuous annealing and the tempering rolling.

This publication discloses that aluminum-killed steel containing not more than 0.1% (not more than 0.04% in the below-mentioned Examples) of C, not more than 0.05% of Si, 0.05 to 0.4% of Mn, 0.01 to 0.1% of acid soluble Al, and 0.002 to 0.01% of N is used as a base material, hot rolling and the cold rolling are performed at a hot rolling finish temperature of from 700° to 900° C. and at cold rolling reduction of 75-93%, respectively, followed by the continuous annealing to give a surface hardness of 43 to 58, and then wet type temper rolling is carried out at a rate of 1.5 to 35% depending upon a desired tempering degree in a range of HR30:44-75 of the surface hardness.

Further, as disclosed in Japanese Patent Application Laid-open Nos. 114,401/1980 and 106,005/1980, there is available a technique that a base sheet with a desired temper degree is selectively prepared by controlling the reduction in the tempering rolling. However, they relate to a method of adjusting the hardness merely by specifying the range of the diameter of the work roll or selectively using the wet rolling or the dry rolling.

Although it is easily inferable when the working hardening in the temper rolling is taken into consideration that the intended temper degree can be attained by temper rolling, this method can attain the hardness as one of the material characteristics required in the tin plate, but it utterly failed to mention the countermeasure in the prevention of the stretcher strain produced in the processing. In particular, the base sheet which is completely freed from the aging after baking can not be produced.

That is, when the base material having the above-mentioned components is subjected to continuous annealing, as mentioned in the foregoing, the strain is introduced in the succeeding temper rolling step since a large amount of the C remains in the solid-solution state in the steel, so that the strain aging is likely to take place. Therefore, there remains unsolved the disadvantage that the strain aging takes place when alloying treatment is made at 230°-300° C. for a few seconds after the temper rolled steel sheet to be plated is plated with tin or when heating is done in drying to obtain the tin free steel after chromium galvanization is performed, so that a conspicuous stretcher strain is induced in processing such as plate working.

With respect to this disadvantage, the present inventors previously disclosed in Japanese Patent Application No. 197,224/1983 a technique for producing soft base steel sheet to be plated with tin by particularly using an extremely low carbon aluminum-killed steel containing not more than 0.002% of C to which Nb may be added upon necessity, and subjecting the steel to the continuous annealing.

Japanese Patent application No. 5,425/1983 was filed with respect to a method of manufacturing the hard base steel sheet to be plated with tin which is free from the occurrence of the stretcher strain by continuously annealing an extremely low carbon steel sheet which contains not more than 0.0030% of C and a cold rolled steel sheet to which Nb or Ti is added upon necessity and temper rolling it at not less than 10%.

It is necessary according to this methods that the content of C is extremely reduced, or Nb or Ti is added, and further, if Nb or Ti is not added, the temper rolling is carried out at a rate of not less than 10% in order to completely prevent the stretcher strain.

SUMMARY OF THE INVENTION

It is an object of the invention to eliminate the problems of the prior art as mentioned above.

More specifically, the object of the present invention is to provide a method of manufacturing a base steel sheet to be surface-treated while being able to advantageously restrain the stretcher strain in the processing.

Upon having examined the method of manufacturing the tinplate being utterly free from the occurrence of the stretcher strain even after tin-melting treatment as well as baking treatment following the tin plating, the present inventors have found that even when the content of C is in a range of not more than 0.007% which can be relatively easily attained, the object intended by the present invention can be advantageously accomplished by performing temper rolling at a draft of not less than 7% by means of two or more stand rolling mill.

That is, according to the present invention, there is a provision of a method of manufacturing a base steel sheet, which method comprises combined steps of: hot rolling a steel slab containing not more than 0.0070% by weight of C (hereinafter referred to briefly as "%" for simplification with respect to the contents of the steel components), not more than 0.1% of Si, not more than 0.5% of Mn, 0.010 to 0.080% of Al, not more than 0.0050% of N, not more than 0.030% of S provided that the ratio of Mn/S is not less than 10, and not more than 0.030% of P while the hot rolling being terminated at a finish temperature of not less than 800° C.; cold rolling thus obtained hot rolled steel sheet in an ordinary manner; continuously annealing the cold rolled steel sheet in which heating is done up to a temperature from a recrystallization temperature to 800° C., followed by cooling; and then temper rolling the annealed steel sheet at a reduction of not less than 7% by using two or more stand rolling mill, whereby the thus obtained base sheet to be surface-treated may be utilized for a tinplate or a tin free steel in which no stretcher strain is formed even after baking treatment, although the manufacturing steps are particularly advantageous.

These and other objects, features, and advantages of the invention will be well appreciated upon reading the following description of the invention when taken in conjunction with the attached drawings with understanding that some modifications, variations and changes of the same could be easily done by the skilled in the art to which the invention pertains without departing from the spirit of the invention or the scope of claim appended thereto.

BRIEF DESCRIPTION OF THE DRAWINGS

For the better understanding of the invention, reference is made of the attached drawings, wherein.

DETAILED DESCRIPTION OF THE INVENTION

According to the present invention, the behavior of the steel components of a base steel sheet to be surface-treated, particularly, C is important.

As previously mentioned, since the content of C is conventionally as high as 0.01 to 0.10%, a large amount of exists in the solid-solution state in the steel due to the quenching during the continuous annealing, and the solute C precipitates on the dislocation lines in the temper rolling and plating-alloying treatment subsequent to the plating to cause the stretcher strain. Accordingly, it is preferable that the content of C present in the solid-solution state in the continuously annealed steel is as small as possible. The most effective method of reducing the content of C in the solid-solution state is to reduce the content of C contained in the steel.

In order to examine the relation among the content of C, the temper rolling rate and the stretcher strain after the baking treatment, vacuum melt steel having different contents of C were experimentally prepared and the following fundamental experiments were carried out.

With the content of C being varied from 0.0020 to 0.12%, the other components of the starting material are almost common in that Si=0.01 to 0.02%, Mn=0.23%, P=0.011-0.012%, S=0.007-0.009%, Al=0.028-0.030%, and N=0.0028-0.0025%.

Each steel was forged to be a sheet bar having a thickness of 30 mm. Then, the hot rolling was performed to obtain a hot rolled sheet of 2.6 mm while the sheet bar was heated at 1,250° C. and the finishing temperature was 860° C. Immediately thereafter, the hot rolled sheet was placed into a furnace of 560° C., and gradually cooled for 30 minutes, which corresponds to the treatment at a coiling temperature of 560° C.

The resulting steel sheet was cold rolled up to a thickness of 0.32 mm by a small scale rolling mill after pickling, and then subjected to the recrystallization annealing in the continuous annealing cycle.

That is, by using a heat-treating simulator, the cold rolled steel sheet was rapidly heated up to 710° C. at a rate of 15° C./sec. and maintained at this temperature for 30 minutes, and then quenched down to room temperature at a rate of 10° C./sec.

Subsequently, after one-pass or two-pass temper rolling was carried out at various reduction by using a small scale rolling mill, the resulting cold rolled steel sheet was placed in an oil bath of 250° C. for 3 seconds and then cooled with water so that the subsequent alloying treatment after plating and galvanizing was experimentally carried out.

Then, the baking treatment was carried out at 210° C. for 20 minutes.

Figure 1:
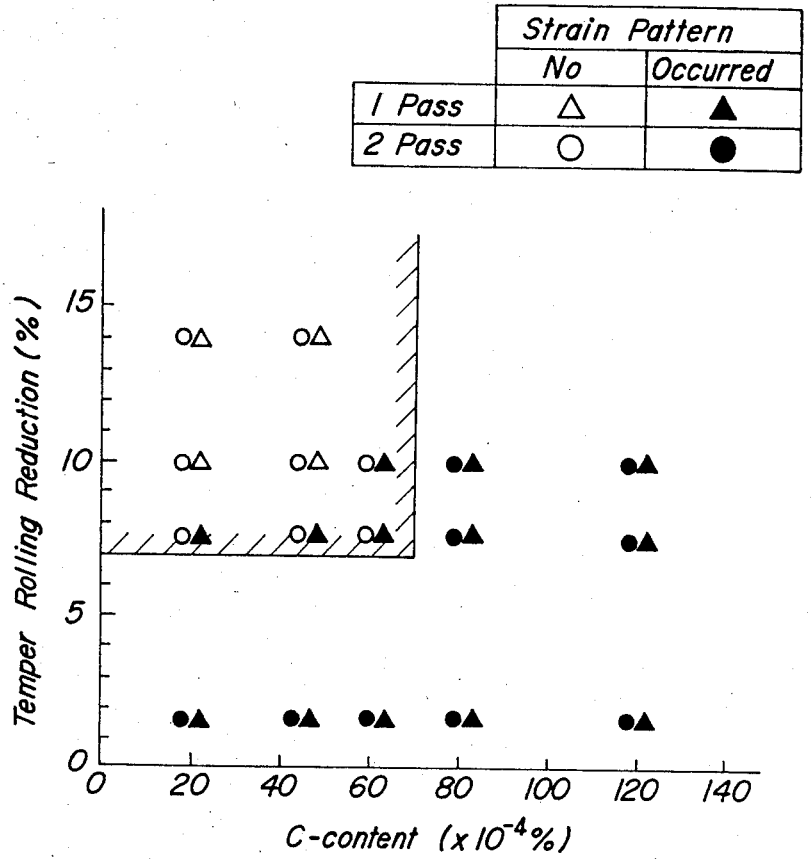
FIG. 1 is a diagram illustrating an effect of temper rolling reduction and the content of C upon occurrence of the stretcher strain.
Figure 2:
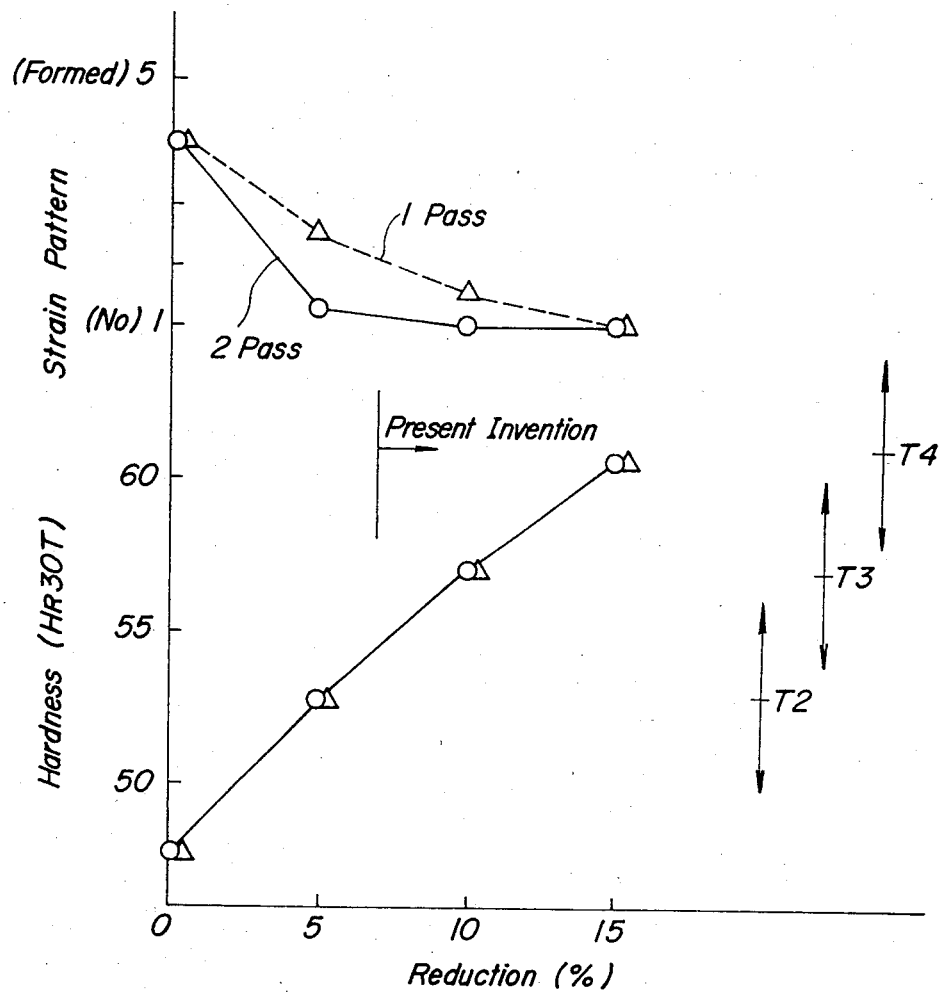
FIG. 2 is a diagram illustrating the influence of the temper rolling reduction upon change in hardness and the occurrence of the strain pattern.

Thereafter, the steel sheet was drawn up to a depth of 5 mm with respect to a steel sheet piece punched in a diameter of 95 mm under the conditions that the diameter of a punching die was 50 mm, a blank holding force was 1 ton and the diameter of a punch was 33 mm. The occurrence of the strain pattern in the drawing was observed by eyes. The relation among the content of C, the temper rolling reduction and the stretcher strain is shown in FIG. 1.

It was observed that even when the temper rolling reduction was the same, the effect in the temper rolling differs between the steel sheets in the one-pass finishing and the two-pass finishing. As obvious from this figure, when the content of C is not more than 0.007%, the temper rolling reduction is not less than 7%, and the rolling is carried out through two-pass, that is, through two stands, the strain pattern appearing at the time of drawing can be reduced to a degree at which no practically unacceptable problem rises. For comparison purpose, the tensile test was conducted with respect to the identically treated materials. As a result, even when yield point elongation was clearly observed from the stress-strain curve in the high reduction temper rolled material, there were many cases where no strain pattern was observed in the above-mentioned shallow drawing test. The reason therefor is not necessarily clear, but it is considered to be due to that the upper yield point is not clear in the high reduction temper rolled material and the stress is slightly increased during being yielded. This deformation behaviour is a phenomenon peculiar to the so-called extremely low carbon steel.

Then, with respect to the components, Si, Mn, S and P in the steel according to the present invention, if such elements are added in excess amount, the grain growth is restrained at the time of the continuous annealing to cause the hardening, which leads to the increase in the hardness in the subsequent temper rolling as well as the interruption of the tinplate from becoming corrosion resistant. Thus, it is preferable that such elements are as few as possible, and it is necessary that Si, Mn, S and P are restrained to not more than 0.1%, not more than 0.5%, not more than 0.030%, and not more than 0.030%, respectively.

Since S which may cause brittleness at the hot rolling is required to be fixed in a form of MnS, Mn is necessary to be $Mn/S \geqq 10$.

Since Al is necessary to fix N in a form of aluminum nitride, it is necessary that Al is in an amount of 0.010% at the minimum. The addition of too much amount thereof leads to cost-up, and thus the upper limit is set at 0.080%.

Since N may cause the stretcher strain in the processing of the product as in the case with C if N is present in the solid-solution state after the continuous annealing, N is preferably as few as possible. When the upper limit thereof is set at 0.005%, the abovementioned fixing with Al can be attained.

As mentioned above, with respect to the molten steel having the thus adjusted components, the slab having appropriately undergone the slabbing in the ingot making or more preferably the continuous casting is subjected to the hot rolling during the processing processes according to the present invention. In the case of the extremely low carbon steel, particularly, containing no additive element such as Nb, the grain diameter becomes too larger if the hot rolling finish temperature becomes less than 800° C., so that the rough surface not only occurs in drawing, but also the aging property is rapidly deteriorated. Thus, the hot rolling finish temperature is set at not lower than 800° C.

The other hot rolling conditions and cold rolling conditions than the above are not particularly required to be restricted, and may be according to the ordinary ones.

In the conditions of the continuous annealing following the cold rolling, it is necessary to set the annealing temperature at not lower than the recrystallization temperature. However, if the annealing temperature exceeds 800° C., it becomes not only extremely difficult to pass the sheet in the continuous annealing but also the grain becomes larger to cause the rough surface. Thus, the upper limit of the annealing temperature is set at 800° C.

According to the present invention, the plated steel sheet such as the tinplate or tin free steel having the peculiarity that completely no stretcher strain caused by the yield point elongation, that is, the strain pattern, is produced after the tin plating and tin-melting treatment or the corresponding treatment in the tin free steel is obtained merely by employing the extremely low carbon aluminum-killed steel with not more than 0.0070% of C as a raw material and temper rolling of the cold rolled steel sheet thereof at 7% after the continuous annealing.

The steel sheet as continuous annealed is extremely soft, because the raw material is an extremely low carbon Al killed steel, and therefore, the rolling at 7% reduction can be easily performed by the temper rolling mill.

Then, with respect to the effects of the reduction in the temper rolling, the following confirmation tests were carried out.

As the raw material, a steel containing 0.0035% of C, 0.01% of Si, 0.23% of Mn, 0.31% of Al, 0.0031% of N, 0.011% of P, and 0.007% of S was experimentally produced through vacuum melting, and the producing steps up to the continuous annealing were identically performed as mentioned in the fundamental experiment.

The steel sheet having undergone the continuous annealing was temper rolled at 7–20% in two passes and maintained in an oil bath at 250° C. for 3 seconds, and then was subjected to a treatment corresponding to baking at 210° C. for 20 minutes.

Then, the hardness measurement and the same shallow drawing test as mentioned in the fundamental experiment were carried out to examine the strain pattern.

There was produced no strain pattern in any of the temper rolling rate while being accompanied by no problems. It will be understood that the temper rolling reductions 7%, 10% and 15% are suitable for the production of the tinplates with the temper degree of around T-2 ½, T-3, T-4, respectively.

As mentioned above, the present invention is to establish the process of advantageously producing the tinplate and the tin-free steel with the temper degree of not less than 2 which is free from the production of the stretcher strain on the basis of the completely novel concept that the extremely low carbon Al-killed steel containing not more than 0.0070% of C as the raw material is combined with the temper rolling. Any sort of the conventionally used rolling mills having two ore more stands may do.

(Example)

A steel having a composition shown in Table 1 was prepared through melting in a converter to prepare a slab in continuous casting. The slab was finished to be 2.3 mm under the hot rolling conditions shown in Table 1.

The resulting sheet was cold rolled down to 0.8 mm by means of a tandem mill after pickling.

Figure 3:
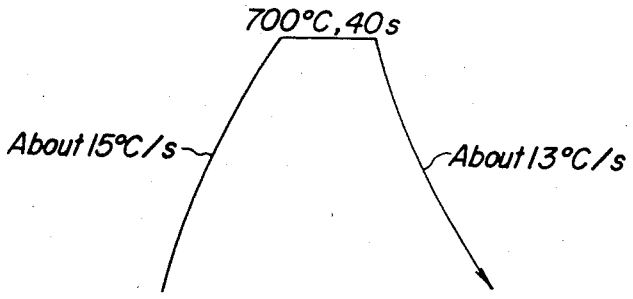
FIG. 3 is a heat cycle of a continuously annealing furnace used in Examples.

Next, the continuous annealing was carried out in a continuously annealing furnace according to a heat cycle shown in FIG. 3. After the steel sheet thus obtained was subjected to the temper rolling totally at 1.5%, 8% and 15% by a three stand rolling mill and No. 25 tin plating was carried out in an electroplating line, the tin melting treatment was performed.

The steel sheet thus obtained was further subjected to a treatment corresponding to baking at 210° C. for 20 minutes, and the hardness was measured, while shallow drawing test similarly as mentioned in the fundamental experiment was carried out thereon.

Samples (A)-(C), (F) and (G) are all fallen in the scope of the present invention, and the temper rolling at 8% and 15% gave tinplates with the tempering degrees of T3 and T4, respectively. These steel sheets suffered from completely no strain pattern even in the shallow drawing test, and exhibit excellent processability.

However, although Steel (D) did not produce of the strethcer strain, the surface thereof after the processing showed the roughed state, so that this steel was not suitable for the deep drawing. Since steel (E) contained a large amount of solid-solution C, the strain pattern could not be completely prevented by the rolling at around 8–15%.

TABLE 1

| | | Chemical component (wt. %) | | | | | | | Hot rolling conditions (°C.) | |
|---|---|---|---|---|---|---|---|---|---|---|
| | Steel | C | Si | Mn | P | S | Al | N | Finish temperature | Coiling temperature |
| Present invention | A | 0.0021 | 0.01 | 0.23 | 0.011 | 0.008 | 0.031 | 0.0025 | 850 | 580 |
| | B | 0.0040 | 0.01 | 0.25 | 0.010 | 0.007 | 0.028 | 0.0028 | 870 | 550 |
| | C | 0.0017 | 0.01 | 0.15 | 0.010 | 0.009 | 0.035 | 0.0030 | 870 | 550 |
| Comparative example | D | 0.0017 | 0.01 | 0.15 | 0.010 | 0.009 | 0.035 | 0.0030 | 770 | 600 |
| | E | 0.0100 | 0.01 | 0.30 | 0.011 | 0.010 | 0.028 | 0.0035 | 850 | 520 |
| Present invention | F | 0.0063 | 0.01 | 0.21 | 0.013 | 0.012 | 0.045 | 0.0041 | 890 | 520 |
| | G | 0.0055 | 0.01 | 0.22 | 0.013 | 0.013 | 0.051 | 0.0033 | 880 | 530 |

TABLE 2

| Steel | Reduction (%) in temper rolling | Hardness ($H_R$ 30T) | Temper degree | Strain pattern*1 | Remarks |
|---|---|---|---|---|---|
| A | 1.5 | 47.1 | T1 | x | Present invention |
| | 8 | 55.0 | T3 | o | |
| | 15 | 60.1 | T4 | o | |
| B | 1.5 | 49.0 | T1 | x | |

TABLE 2-continued

| Steel | Reduction (%) in temper rolling | Hardness ($H_R$ 30T) | Temper degree | Strain pattern*1 | Remarks |
|---|---|---|---|---|---|
| | 8 | 57.2 | T3 | o | |
| | 15 | 61.3 | T4 | o | |
| C | 1.5 | 46.0 | T1 | x | |
| | 8 | 54.8 | T3 | o | |
| | 15 | 59.5 | T4 | o | |
| D | 1.5 | 44.3 | T1 | x | Comparative example |
| | 8 | 53.2 | T2 | o*2 | |
| | 15 | 58.5 | T3 | o*2 | |
| E | 1.5 | 55.4 | T3 | x | |
| | 8 | 60.3 | T4 | x | |
| | 15 | 63.1 | T4 | x | |
| F | 1.5 | 52.1 | T1 | x | Present invention |
| | 8 | 58.3 | T3 | o | |
| | 15 | 61.2 | T4 | o | |
| G | 1.5 | 51.3 | T1 | x | |
| | 8 | 57.0 | T3 | o | |
| | 15 | 60.9 | T4 | o | |

*1o no strain pattern
x strain pattern occurred
*2rough skin

What is claimed is:

1. A method of manufacturing a base steel sheet for plating, which method comprises combined steps of:

hot rolling steel slab containing not more than 0.0070% by weight of C, not more than 0.1% by weight of Si, not more than 0.5% by weight of Mn, 0.010 to 0.080% by weight of Al, not more than 0.0050% by weight of N, not more than 0.030% by weight of S provided that the ratio of Mn/S is not less than 10, and not more than 0.030% by weight of P while the hot rolling being terminated at a finish temperature of not less than 800° C.;

cold rolling thus obtained hot rolled steel sheet in an ordinary manner;

continuously annealing the cold rolled steel sheet in which heating is done up to a temperature from a recrystallization temperature to 800° C., followed by cooling; and then temper rolling the annealed steel sheet at a reduction of not less than 7% by using two or more stand rolling mill.

* * * * *